US006155224A

United States Patent [19]

Akihisa et al.

[11] Patent Number: 6,155,224

[45] Date of Patent: Dec. 5, 2000

[54] NOISE SILENCER FOR VEHICLE ENGINE INTAKE SYSTEM

[75] Inventors: Hiroki Akihisa, Kariya; Toshiaki Nakayama, Nishikamo-gun; Shuya Mikami, Anjo, all of Japan

[73] Assignee: Denso Corporation, Japan

[21] Appl. No.: 09/332,590

[22] Filed: Jun. 14, 1999

[30] Foreign Application Priority Data

Aug. 18, 1998 [JP] Japan ..... 10-231403
Mar. 19, 1999 [JP] Japan ..... 11-075482

[51] Int. Cl.[7] ..... F02M 35/12

[52] U.S. Cl. ..... 123/184.57

[58] Field of Search ..... 181/204, 229; 123/184.21, 184.61, 198 E, 184.57, 184.54, 184.53

[56] References Cited

U.S. PATENT DOCUMENTS 3,712,416 1/1973 Swanson et al. ..... 123/198 E
4,538,556 9/1985 Takeda ..... 123/184.57
5,571,239 11/1996 Kameda et al. ..... 123/184.21
5,572,966 11/1996 Doddy et al. ..... 123/184.57

FOREIGN PATENT DOCUMENTS 61-62212 U 4/1986 Japan .
64-41609 2/1989 Japan .
5-187336 7/1993 Japan .

*Primary Examiner*—Willis R. Wolfe
*Assistant Examiner*—Hyder Ali
*Attorney, Agent, or Firm*—Nixon & Vanderhye PC

[57] ABSTRACT

A noise silencer for reducing noise in an intake passage in an intake system has a parabolic portion for collecting noise, a noise accumulation room communicating with the intake passage through a communication passage and a noise discharge pipe communicating with an outside space. A noise collection valve is provided in the communication passage. When sound pressure in the intake passage is positive, i.e., larger than pressure inside the noise accumulation room, the noise collection valve opens the communication passage. As a result, a positive sound pressure portion of low-frequency noise is collected into the noise accumulation room and is discharged outside the intake system. Thus, the noise silencer effectively reduces low-frequency noise in the intake passage and requires less mounting space.

20 Claims, 8 Drawing Sheets

NOISE SILENCER FOR VEHICLE ENGINE INTAKE SYSTEM

CROSS REFERENCE TO RELATED APPLICATION

This application relates to and claims priority from Japanese Patent Application Nos. Hei. 10-231403 filed on Aug. 18, 1998 and Hei. 11-75482 filed on Mar. 19, 1999, the contents of which are hereby incorporated by reference.

BACKGROUND OF THE INVENTION

1. Field of the Invention

The present invention relates to a noise silencer for reducing noise generated in an intake system of a vehicle engine.

2. Related Art

FIG. 14 shows a conventional intake system of a vehicle engine. The intake system has an air cleaner 100, an intake pipe 105 disposed at an upstream air side of the air cleaner 100, an intake pipe 106 disposed at a downstream air side of the air cleaner 100 and a throttle body 101 disposed at a downstream air side of the intake pipe 106. Air is sucked into and flows through the intake pipe 105, the air cleaner 100, the intake pipe 106 and the throttle body 101, and is introduced into each cylinder of an engine 103 through a surge tank 104 and an intake manifold 102. A resonator 107 is attached to the intake pipe 105 and resonators 109, 110 are attached to the intake pipe 106.

In the intake system, noise is generated by negative pressure caused by opening and closing of an intake valve, and is transmitted from the engine 103 to the intake pipe 105. For a 4-cylinder engine, frequency of generated noise is generally 1 kHz or less. That is, generated noise may have frequency such as 100, 200 and 400 Hz with relatively high sound pressure. Hereinafter, frequency level such as a high frequency or a low frequency is a level determined within the frequency of noise generated in the intake system being 1 kHz or less.

The capacity and mounting position of each of the resonators 107, 109 and 110 are adjusted so that each of the resonators 107, 109 and 110 reduce noise having a different frequency. The resonators 107, 109 and 110 respectively reduce noise having a frequency 100, 400 and 200 Hz. Thus, whole noise generated in the intake system is reduced by the resonators 107, 109 and 110.

However, each of the resonators 107, 109 and 110 has a structure for reducing noise in a relatively narrow frequency range. Therefore, a resonator may be required for each 20 frequency range of noise. However, recently, the intake system needs to be compact, and the air cleaner 100 and the throttle body 101 may be directly connected with each other without an intake pipe 106 therebetween. In such a case, the attachment space for the resonators 109, 110 is eliminated, thereby making it difficult to attach several resonators to the intake system corresponding to frequency ranges of noise. Further, the size of a resonator for reducing low-frequency noise is relatively large. Therefore, when the resonator for reducing low-frequency noise is attached to the intake pipe, the size of the intake pipe itself is increased.

JP-A-5-187336 discloses a noise silencer in which noise generated in an intake system of a vehicle engine is reflected by a concave reflection surface and is sent back to an intake side of the engine so that noise in the intake system is reduced.

However, since low-frequency noise may not be sufficiently reflected by the concave reflection surface, this noise silencer may not sufficiently reduce noise in a relatively wide frequency range.

SUMMARY OF THE INVENTION

In view of the foregoing problems, it is an object of the present invention to provide a compact noise silencer which reduces low-frequency noise in an intake system.

It is another object of the present invention to provide a noise silencer which reduces not only low-frequency noise but also high-frequency noise in the intake system.

According to the present invention, a noise silencer for reducing noise in an intake system has a noise accumulation member at least partially exposed to the intake passage. The noise accumulation member has a noise collection hole into which noise is introduced from the intake passage, and forms a noise accumulation room communicating with the noise collection hole and an outer space having a predetermined pressure. valve is disposed in the noise collection hole for opening and closing the noise collection hole according to a change in sound pressure of the noise in the intake passage. When sound pressure of the noise in the intake passage is larger than the predetermined pressure, the valve opens the noise collection hole so that the intake passage communicates with the noise accumulation room. As a result, a portion of noise in which sound pressure is larger than the predetermined pressure is introduced into the noise accumulation room and is discharged to the outer space. Although a portion of noise in which sound pressure is less than the predetermined pressure is left in the intake passage, noise amplitude in the intake passage is reduced. As a result, noise in the intake passage is reduced in a wider frequency range in comparison with a conventional resonator which reduces noise in a relatively narrow frequency range. The noise accumulation member may be disposed in the intake passage. As a result, mounting space of the noise silencer and the intake system is reduced.

Preferably, the valve is made of rubber so that the valve is readily formed into a predetermined shape.

Preferably, the noise silencer has a noise collection member including a parabolic portion, and a noise receiving member. The noise receiving member has a noise receiving hole disposed at a focal point of the parabolic portion and forms a noise receiving room communicating with the intake passage through the noise receiving hole. Therefore, high-frequency noise reflected by the parabolic portion is introduced into the noise receiving room and is attenuated therein. As a result, not only low-frequency noise but also high-frequency noise in the intake passage can be effectively reduced by the noise silencer.

More preferably, the noise collection member and the noise accumulation member are integrally formed. As a result, the number of components of the noise silencer is reduced and assembly of the noise silencer is facilitated.

BRIEF DESCRIPTION OF THE DRAWINGS

This and other objects and features of the present invention will become more readily apparent from a better understanding of the preferred embodiments described below with reference to the accompanying drawings, in which.

DETAILED DESCRIPTION OF THE PREFERRED EMBODIMENTS

Preferred embodiments of the present invention will be described hereinafter with reference to the accompanying drawings.

First Embodiment

Figure 1:
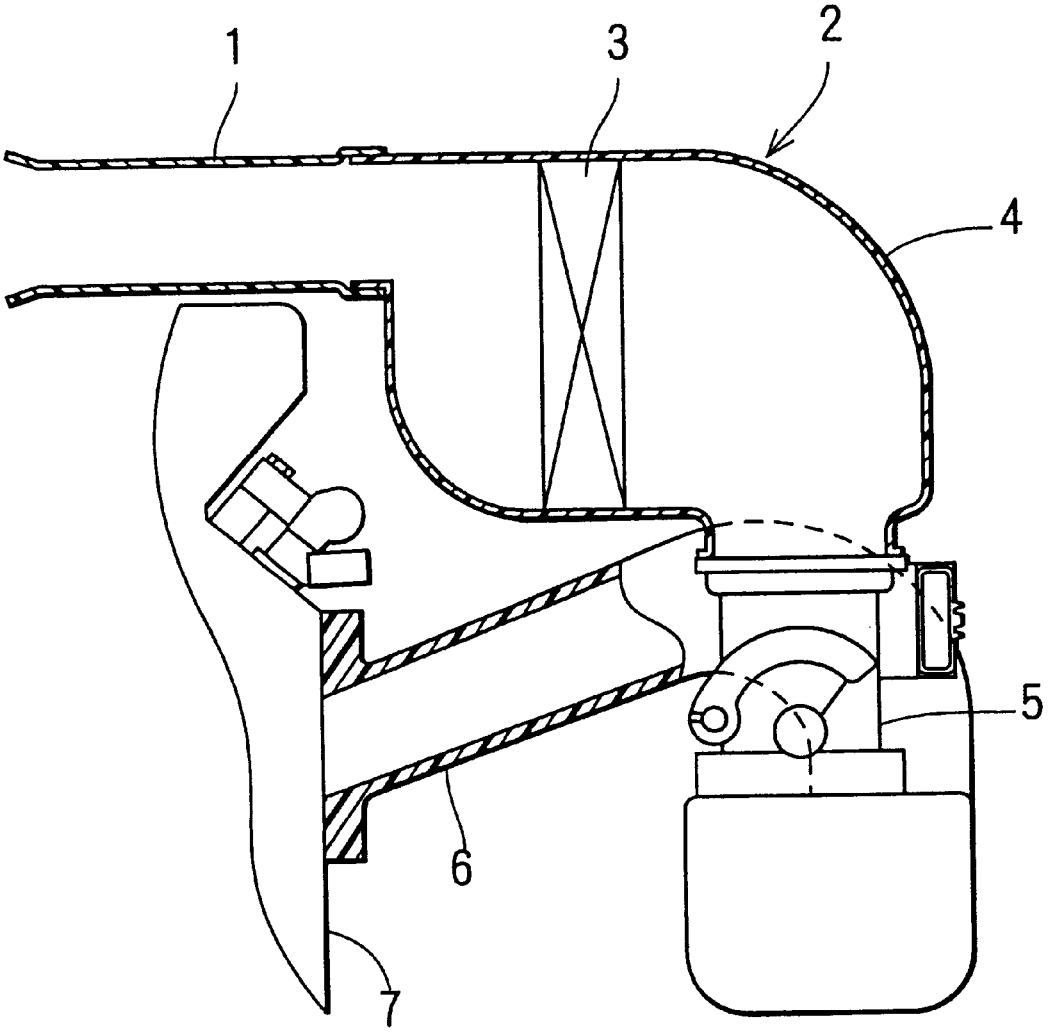
FIG. 1 is a schematic view showing an intake system of a vehicle engine having a noise silencer according to a first preferred embodiment of the present invention.

A first preferred embodiment of the present invention will be described with reference to FIGS. 1–8B. FIG. 1 shows an intake system of a vehicle engine having a noise silencer according to the first embodiment. In the intake system, an intake pipe 1 is connected to an air cleaner 2 at an upstream air side thereof. The air cleaner 2 includes an air cleaner case 4 and a filter 3 disposed in the air cleaner case 4, and is directly connected to a throttle body 5 without an intake pipe disposed therebetween. After foreign matters contained in air flowing through the air cleaner 2 are removed by the filter 3, flowing amount of air is adjusted by the throttle body 5. Then, air is introduced into each cylinder of an engine 7 through an intake manifold 6.

Figure 3:
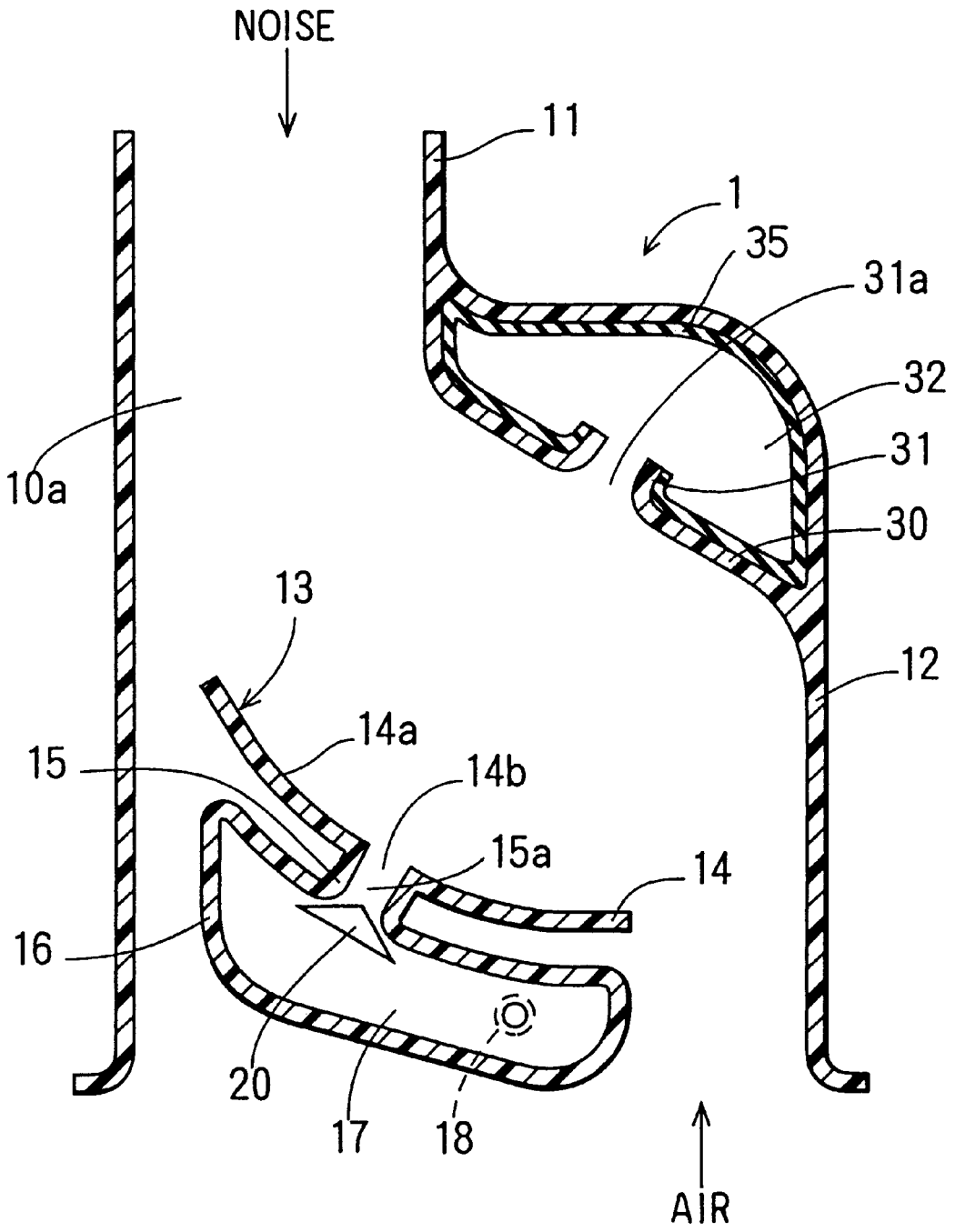
FIG. 3 is a cross-sectional view taken along line III—III in FIG. 2.

As shown in FIG. 3, the noise silencer is disposed in the intake pipe 1 and includes a noise collection member 13, a noise accumulation member 16, a noise discharge pipe 18, a noise collection valve 20, a noise receiving member 30, a pipe portion 31 and part of the intake pipe 1. The intake pipe 1 has a cylindrical portion 11 for forming an intake passage lOa and a box portion 12. In FIG. 3, air is introduced into the intake pipe 1 from a lower part of the box portion 12, flows through the cylindrical portion 11 and is discharged toward the air cleaner 2.

Figure 2:
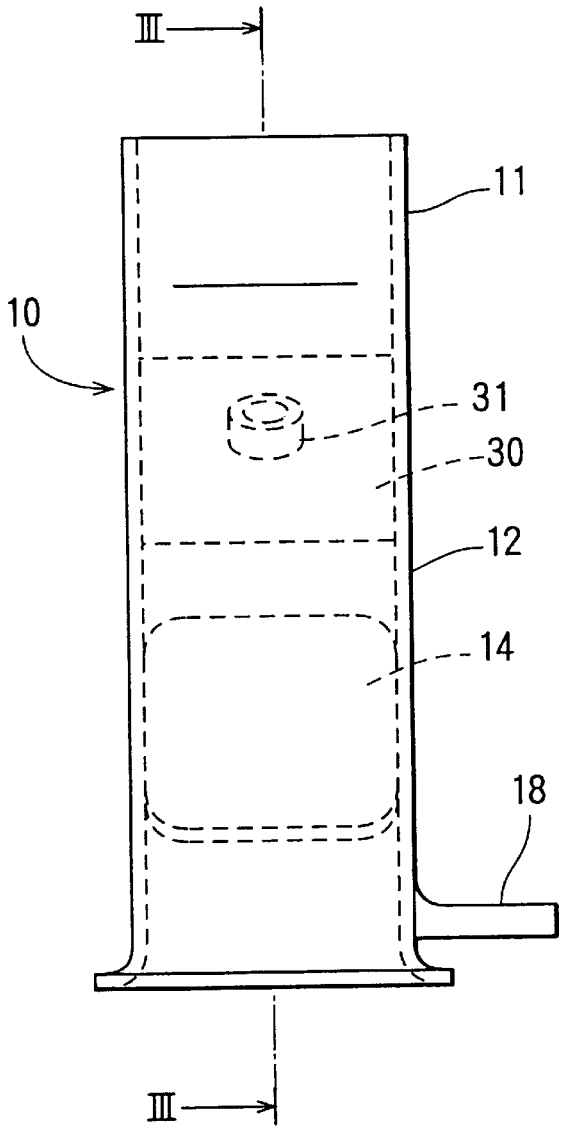
FIG. 2 is a flat view showing the noise silencer according to the first embodiment.

The noise collection member 13 is disposed inside the box portion 12, and has a parabolic portion 14 for collecting noise and a communication pipe 15. A concave surface 14*a* of the parabolic portion 14 faces a direction in which noise comes from so that the concave surface 14*a* effectively collects noise. In the intake pipe 1, air flows toward the direction in which noise comes from. The parabolic portion 14 has a noise collection hole 14*b* at a center bottom thereof, and is connected to the noise accumulation member 16 through the communication pipe 15. The noise accumulation member 16 forms a noise accumulation room 17 therein. The communication pipe 15 forms a communication passage 15*a* therein. The noise accumulation room 17 communicates with the noise collection hole 14*b* through the communication passage 15*a*. The noise discharge pipe 18 is connected to the box portion 12 of the intake pipe 1 so that the noise accumulation room 17 communicates with an outer space having atmospheric pressure outside the intake pipe 1 through the noise discharge pipe 18 as shown in FIG. 2.

The noise collection valve 20 controls communication between the communication passage 15*a* and the noise accumulation room 17. That is, when sound pressure in the intake passage 10*a* is larger than atmospheric pressure of the outer space (hereinafter referred to as positive), the noise collection valve 20 opens the noise collection hole 14*b* and the communication passage 15*a*. As a result, the intake passage 10*a* communicates with the noise accumulation room 17 through the noise collection hole 14*b* and the communication passage 15*a*.

Figure 4A:
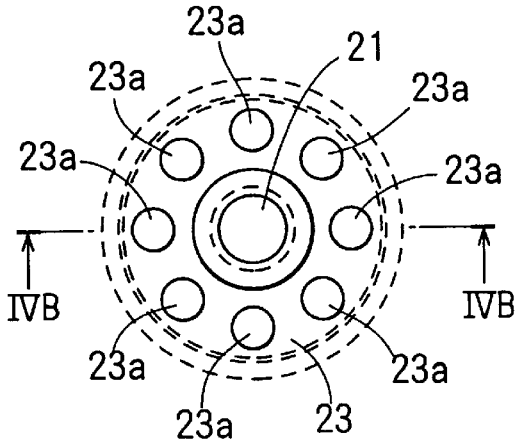
FIG. 4A is a front view showing a noise collection valve according to the first embodiment and FIG. 4B is a cross-sectional view taken along line IVB—IVB.
Figure 4B:
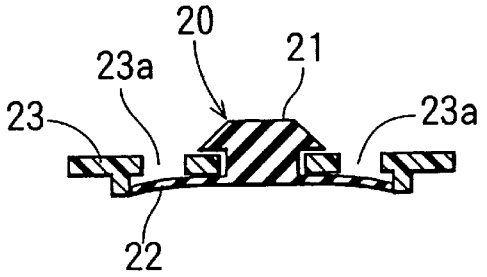

FIGS. 4A and 4B show a structure of the noise collection valve 20. The noise collection valve 20 is made of rubber and has an engaging portion 21 and a circular plate portion 22. An attachment member 23 to which the noise collection valve 20 is attached is formed by a part of one of the parabolic portion 14, the communication pipe 15 or the noise accumulation member 16. A communication passage 23*a* is formed between the noise collection valve 20 and the attachment member 23. Thus, the intake passage 10*a* and the noise accumulation room 17 communicates with each other through the communication passages 15*a*, 23*a*. When sound pressure in the intake passage 10*a* is less than atmospheric pressure of the outer space (hereinafter referred to as negative), the circular plate portion 22 makes contact with the attachment member 23, thereby closing the communication passage 23*a*. When sound pressure in the intake passage 10*a* is positive, an outer peripheral portion of the circular plate portion 22 is separated from the attachment member 23. As a result, the communication passage 23*a* is opened, thereby enabling the intake passage 10*a* to communicate with the noise accumulation room 17.

Referring back to FIG. 3, the noise receiving member 30 is disposed to face the parabolic portion 14. The pipe portion 31 for receiving noise is formed in the noise receiving member 30 at a focal point of the parabolic portion 14. A noise receiving room 32 is formed by the noise receiving member 30 and a part of the box portion 12 of the intake pipe 1. The pipe portion 31 forms a noise receiving hole 31a through which the intake passage 10*a* and the noise receiving room 32 communicate with each other.

Figure 5A:
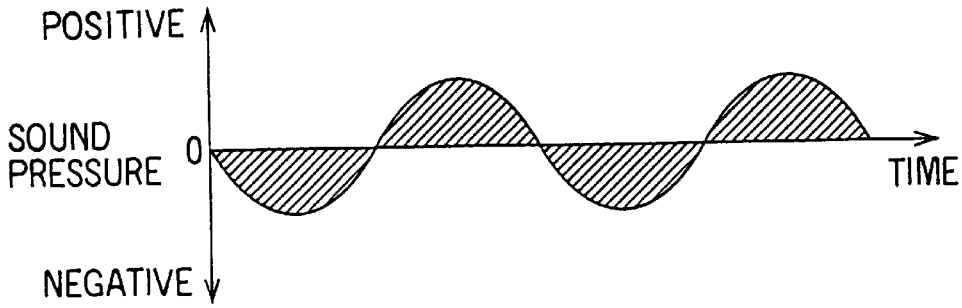
FIG. 5A is a characteristic diagram showing sound pressure of noise in an intake passage according to the first embodiment and FIG. 5B is a characteristic diagram showing sound pressure of noise in the intake passage after the noise collection valve is opened according to the first embodiment.
Figure 5B:
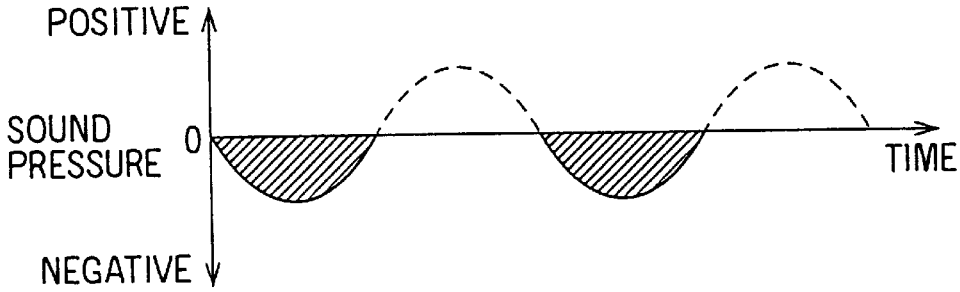

Next, operation of the noise silencer according to the first embodiment of the present invention will be described. Referring to FIG. 1, when an intake valve (not shown) is opened and closed, negative pressure is generated and turbulence occurs in the intake passage. As a result, noise is generated and is transmitted from the engine 7 to the intake pipe 1 through the throttle body 5 and the air cleaner 2. The noise transmitted to the intake passage 10*a* has positive sound pressure and negative sound pressure as shown in FIG. 5A. In the first embodiment, the noise accumulation room 17 is opened to the outer space having atmospheric pressure through the noise discharge pipe 18. Therefore, the noise collection valve 20 is opened by positive sound pressure of low-frequency noise in the intake passage 10*a* to open the noise collection hole 14*b* and the communication passage 15*a*. As a result, a positive sound pressure portion of the low-frequency noise are introduced into the noise accumulation room 17, and low-frequency frequency noise left in the intake passage 10*a* has a waveform having only a negative pressure portion as shown in FIG. 5B. Therefore, the amplitude of low-frequency noise in the intake passage 10*a* is reduced, thereby reducing low-frequency noise in the intake passage 10*a*. Since the noise collection hole 14*b* is closed by the noise collection valve 20, low-frequency noise in the noise accumulation room 17 is accumulated therein with sound pressure, and the sound pressure is discharged outside the intake system through the noise discharge pipe 18.

Figure 6:
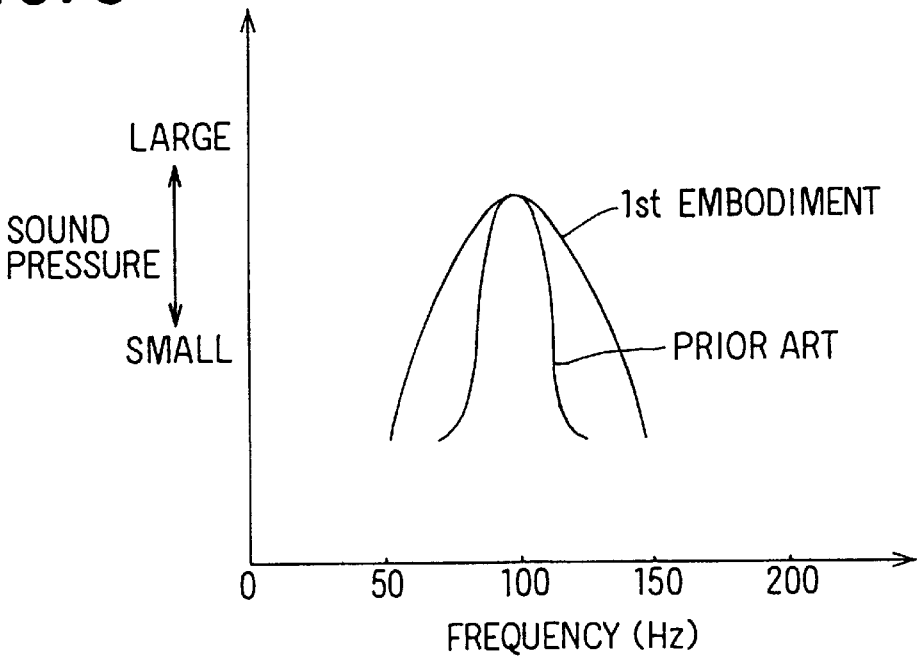
FIG. 6 is a characteristic diagram showing a relationship between sound pressure and frequency of noise collected by the noise collection valve according to the first embodiment.

As shown in FIG. 6, the noise collection valve 20 according to the first embodiment collects noise in a frequency range of approximately 50–150 Hz. Thus, the noise collection valve 20 can collect noise in a wider frequency range in comparison with a conventional resonator which collects noise in a relatively narrow frequency range. In the first embodiment, the noise collection valve 20 is opened by positive sound pressure of noise having a frequency of 200 Hz or less to reduce noise within the intake pipe 1.

High-frequency noise having frequency of 200 Hz or more (e.g., 400 Hz), which is not collected by the noise collection valve 20, is reflected by the parabolic portion 14, and is introduced into the noise receiving room 32 through the noise receiving hole 31*a*. In the noise receiving room 32, noise is attenuated similarly in a conventional resonator. Thus, in the first embodiment, high-frequency noise is reflected by the parabolic portion 14 and is introduced into the noise receiving room 32 through the noise receiving hole 31*a*. Therefore, noise in the intake passage 10*a* is more effectively reduced in comparison with the conventional resonator. Further, as shown in FIG. 3, in the first embodiment, a sound absorbing member 35 is disposed on an inner wall forming the noise receiving room 32. The sound absorbing member 35 is a porous member such as sponge made of glass wool, polyurethane or the like.

According to the first embodiment, most of the noise silencer is disposed inside the intake pipe 1. Therefore, mounting space of the intake pipe 1 including the noise silencer is reduced.

Figure 7A:
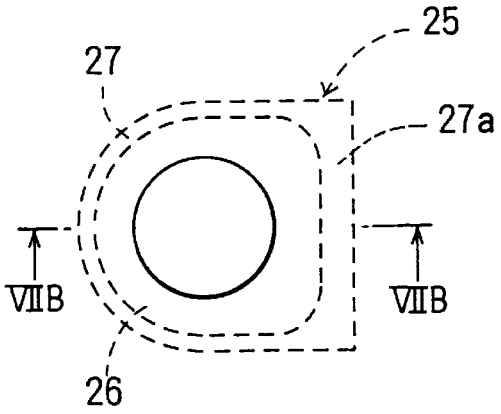
FIG. 7A is a front view showing a noise collection valve according to a modification of the first embodiment and FIG. 7B is a cross-sectional view taken along line VIIB—VIIB in FIG. 7A.
Figure 7B:
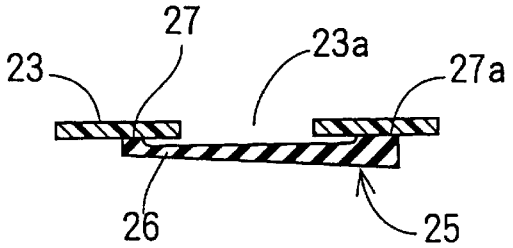

FIGS. 7A and 7B show a modification of the noise collection valve 20 in the first embodiment. A noise collection valve 25 is made of rubber and has a flat plate portion 26 and an annular protruding portion 27*a* protruding from an outer peripheral portion of the flat plate portion 26 toward the attachment member 23. The protruding portion 27 has a securing portion 27*a* connected to the attachment member 23 through adhesive or the like. When round pressure in the intake passage 10*a* is negative, the annular protruding portion 27 makes contact with the attachment member 23, thereby preventing communication between the intake passage 10*a* and the noise accumulation room 17. When sound pressure in the intake passage 10*a* is positive, the annular protruding portion 27 except the securing portion 27*a* is separated from the attachment portion 23. As a result, the intake passage 10*a* communicates with the noise accumulation room 17, and a positive sound pressure portion of low-frequency noise is collected into the noise accumulation room. 17 to be attenuated therein. Thus, with the noise collection valve 25, the same effect of the noise collection valve 20 is obtained.

Figure 8A:
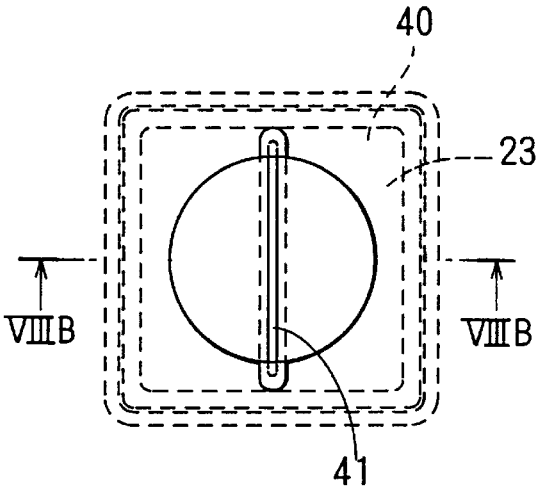
FIG. 8A is a front view showing a noise collection valve according to another modification of the first embodiment and FIG. 8B is a cross-sectional view taken along line VIIIB—VIIIB in FIG. 8A.
Figure 8B:
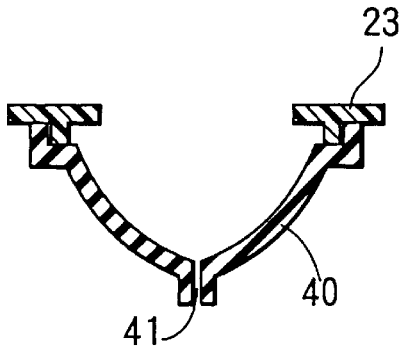

FIGS. 8A and 8B show another modification of the noise collection valve 20 in the first embodiment. A noise collection valve 40 is made of rubber and has a semi-circular cross-section. An outer peripheral portion of the noise collection valve 40 is secured to the attachment member 23. Further, a notch 41 is made at a center of the semi-circular cross-section of the noise collection valve 40 to extend along a longitudinal direction of the noise collection valve 40. When sound pressure in the intake passage 10*a* is negative, the notch 41 is closed. When sound pressure in the intake passage 10*a* is positive, the notch 41 is opened, and the intake passage 10*a* communicates with the noise accumulation room 17. As a result, a positive sound pressure portion of low-frequency noise is collected into the noise accumulation room 17 and is attenuated therein. Thus, with the noise collection valve 40, the same effect of the noise collection valve 20 is obtained.

The above-mentioned noise collection valves 20, 25 and 40 may be made of metal chip or metal thin film instead of rubber.

Second Embodiment

Figure 9:
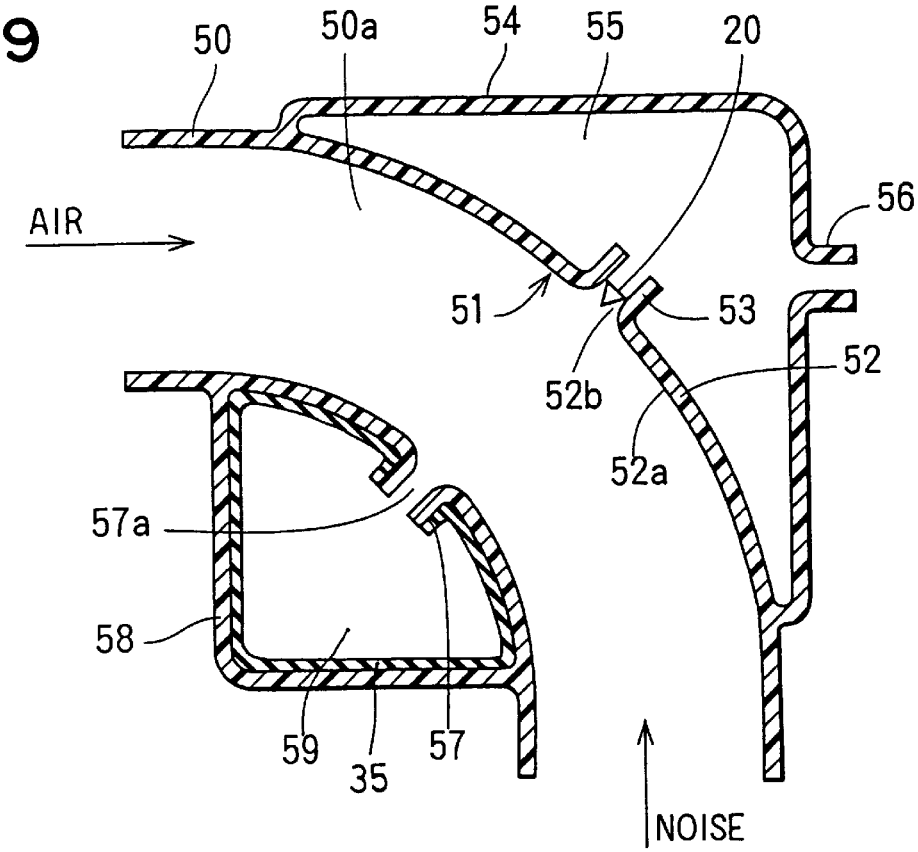
FIG. 9 is a cross-sectional view showing a noise silencer according to a second preferred embodiment of the present invention.

A second preferred embodiment of the present invention will be described with reference to FIG. 9. In this and following embodiments, components which are similar to those in the first embodiment are indicated with the same reference numerals, and the explanation thereof will be omitted.

In the second embodiment, the noise silencer is disposed in a bent portion of an intake pipe 50 connected to the air cleaner 2. The intake pipe 50 has an intake passage 50*a* therein, and is disposed at a downstream air side of the air cleaner 2 or at an upstream air side of the air cleaner 2.

A part of the bent portion of the intake pipe 50 forms a noise collection member 51 having a parabolic portion 52 for collecting noise and a communication pipe 53. A concave surface 52*a* of the parabolic portion 52 faces a direction in which noise comes from so that the concave surface 52*a* effectively collects noise. In the intake pipe 50, air flows toward the direction in which noise comes from. A noise accumulation member 54 is disposed outside the intake pipe 50.

A noise accumulation room 55 is formed by the noise accumulation member 54 and the part of the intake pipe 50. The communication pipe 53 forms a noise collection hole 52*b* through which the intake passage 50*a* communicates with the noise accumulation room 55. When sound pressure in the intake passage 50*a* is positive, the noise collection hole 52*b* is opened by the noise collection valve 20. As a result, the intake passage 50*a* communicates with the noise accumulation room 55. A noise discharge port 56 is connected to the noise accumulation member 54 and communicates with the noise accumulation room 55.

A pipe portion 57 for receiving noise is formed in a part of the intake pipe 50 at a focal point of the parabolic portion 52. A noise receiving member 58 is disposed outside the intake pipe 50, and a noise receiving room 59 is formed by the noise receiving member 58 and a part of the intake pipe 50. The pipe portion 57 forms a noise receiving hole 57*a* through which the intake passage 50*a* communicates with the noise receiving room 59.

In the second embodiment, low-frequency noise in the intake passage 50*a* is collected into the noise accumulation room 55 and is attenuated therein. Low-frequency noise accumulated in the noise accumulation room 55 is discharged outside the intake system through the noise discharge pipe 56. On the other hand, high-frequency noise not collected by the noise collection valve 20 is reflected by the parabolic portion 52 and is introduced into the noise receiving room 59 through the noise receiving hole 57*a*. Then, high-frequency noise is attenuated in the noise receiving room 59.

According to the second embodiment, the bent portion of the intake pipe 50 forms the noise collection member 51. As a result, a structure of the noise silencer is further simplified.

Third Embodiment

A third preferred embodiment of the present invention will be described with reference to FIG. 10. In the third embodiment, the noise silencer is disposed in the air cleaner 2.

Figure 10:
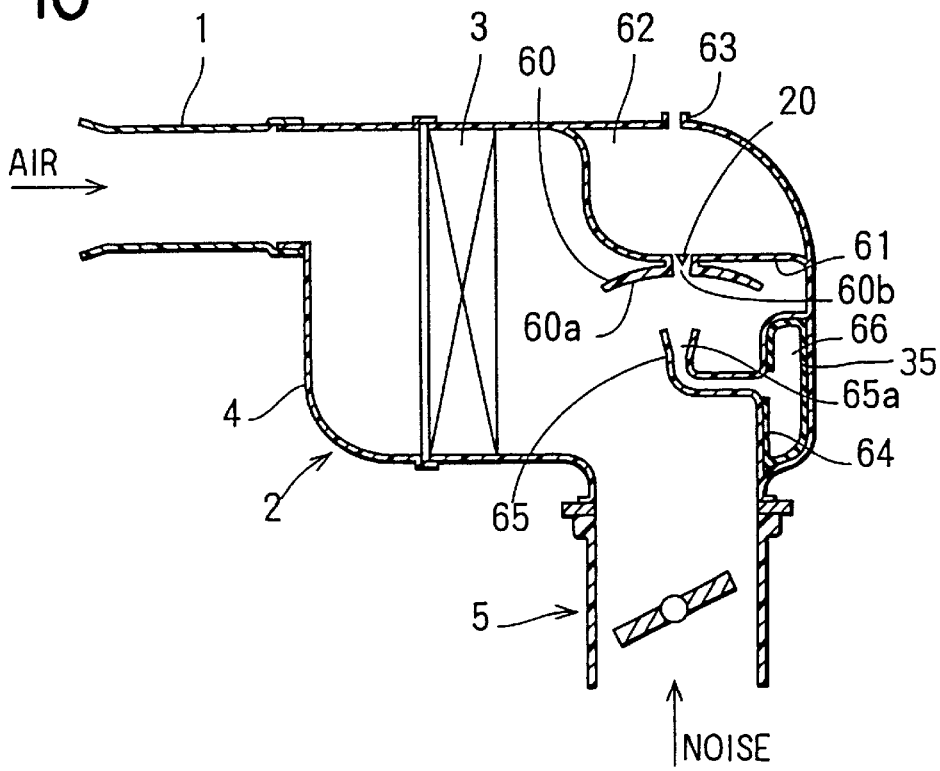
FIG. 10 is a cross-sectional view showing a noise silencer according to a third preferred embodiment of the present invention.

As shown in FIG. 10, a parabolic portion 60 for collecting noise and a noise accumulation member 61 are disposed in the air cleaner case 4. The parabolic portion 60 has a concave surface 60*a* and a noise collection hole 60*b*. The concave surface 60*a* faces a direction in which noise comes from so that the concave surface 60*a* effectively collects noise. In the intake pipe 1 and the air cleaner 2, air flows toward the direction in which noise comes from. A noise accumulation room 62 is formed by the noise accumulation member 61 and the air cleaner case 4. A noise discharge pipe 63 trough which the noise accumulation room 62 communicates with the outer space is formed in the air cleaner case 4. A space inside the air cleaner case 4 communicates with the noise accumulation room 62 when the noise collection valve 20 opens the noise collection hole 60*b*.

A noise receiving member 64 is also disposed in the air cleaner case 4 and forms a noise receiving room 66 in cooperation with the air cleaner case 4. The noise receiving member 64 has a pipe portion 65 for receiving noise. The pipe portion 65 forms a noise receiving hole 65*a* disposed at a focal point of the parabolic portion 60. The space inside the air cleaner case 4 communicates with the noise receiving room 66 through the noise receiving hole 65*a*.

In the third embodiment, a positive sound pressure portion of low-frequency noise is collected into the noise accumulation room 62 to be accumulated therein, and is discharged outside the intake system through the noise discharge pipe 63. On the other hand, high-frequency noise not collected by the noise collection valve 20 is reflected by the parabolic portion 60 and is introduced into the noise receiving room 66 through the noise receiving hole 65*a* to be attenuated therein.

According to the third embodiment, the noise silencer is disposed in an affordable space in the air cleaner 2. Therefore, the noise silencer can be disposed in the air cleaner 2 without increasing size of the air cleaner 2. Thus, mounting space of the intake system is reduced.

In the above-mentioned first through third embodiments, the sound absorbing member 35 is attached to an inner wall forming the noise receiving rooms 32, 59 and 66 so that highfrequency noise is more effectively reduced.

Fourth Embodiment

Figure 11:
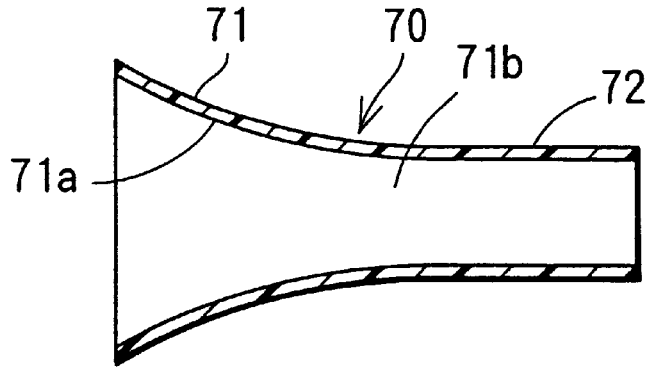
FIG. 11 is a cross-sectional view showing a noise collection member of a noise silencer according to a fourth preferred embodiment of the present invention.

A fourth preferred embodiment of the present invention will be described with reference to FIGS. 11–13. In the fourth embodiment, the noise collection member 13 in the first embodiment is modified. As shown in FIG. 11, a noise collection member 70 has a noise collection portion 71 having a horn-like cross-section and a communication pipe 72 through which the noise collecting portion 71 is connected to the noise accumulation member 16 in the first embodiment. A concave surface 71*a* of the noise collection portion 71 faces a direction in which noise comes from so that the concave surface 71*a* effectively collects noise. The noise collection valve 20 is disposed at a connection portion between the noise collection member 70 and the noise accumulation member 16. When sound pressure in the intake passage 10*a* is positive, the noise collection valve 20 opens the noise collection hole 71*b* so that a positive sound pressure portion of low-frequency noise is collected into the noise accumulation room 17.

In the fourth embodiment, the noise collection member 71 can not reflect high-frequency noise toward a specific portion due to a structure thereof. Therefore, in the forth embodiment, low-frequency noise is mainly reduced. That is, the horn-like noise collection member 70 is used not to reflect noise, but to introduce noise into the noise accumulation room 17. only noise having a wavelength half of which is equal to or less than diameter of an opening of the noise collection portion 71 can be introduced into the noise accumulation room 17 by the noise collection member 70. In the fourth embodiment, the noise receiving room 32 is not required, thereby reducing size of the noise silencer.

Figure 12:
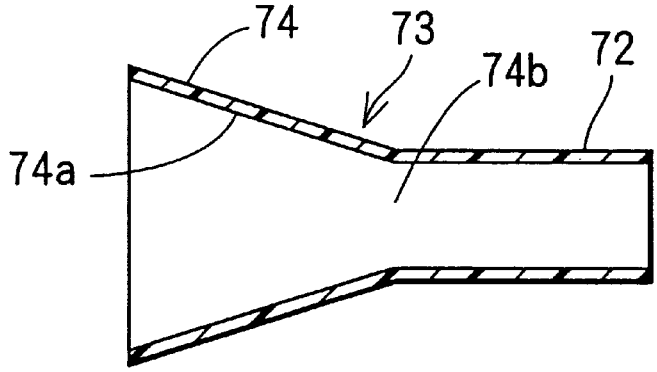
FIG. 12 is a cross-sectional view showing a noise collection member according to a modification of the fourth embodiment.

As shown in FIG. 12, a noise collection member 73 may be used instead of the noise collection member 70. The noise collection member 73 has a noise collection portion 74 having a truncated-cone-shaped cross-section. A concave surface 74*a* of the noise collection member 74 faces a direction in which noise comes from so that the concave :surface 74*a* effectively collects noise. The noise collection valve 20 is disposed at a connection portion between the noise collection member 73 and the noise accumulation member 16. When sound pressure in the intake passage 10*a* is positive, a noise collection hole 74*b* is opened by the noise collection valve 20.

Figure 13:
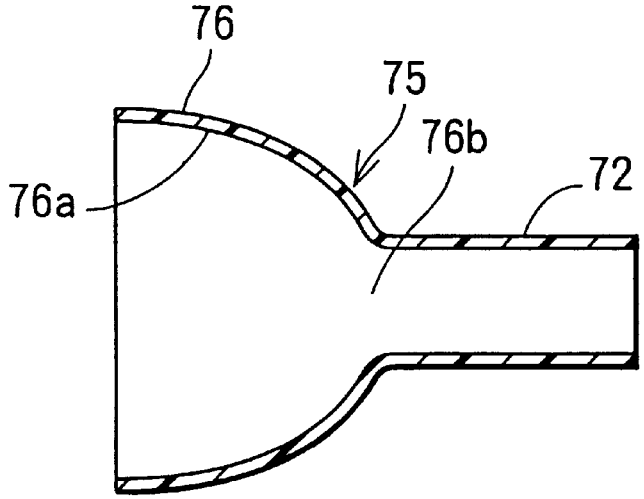
FIG. 13 is a cross-sectional view showing a noise collection member according to another modification of the fourth embodiment.
Figure 14:
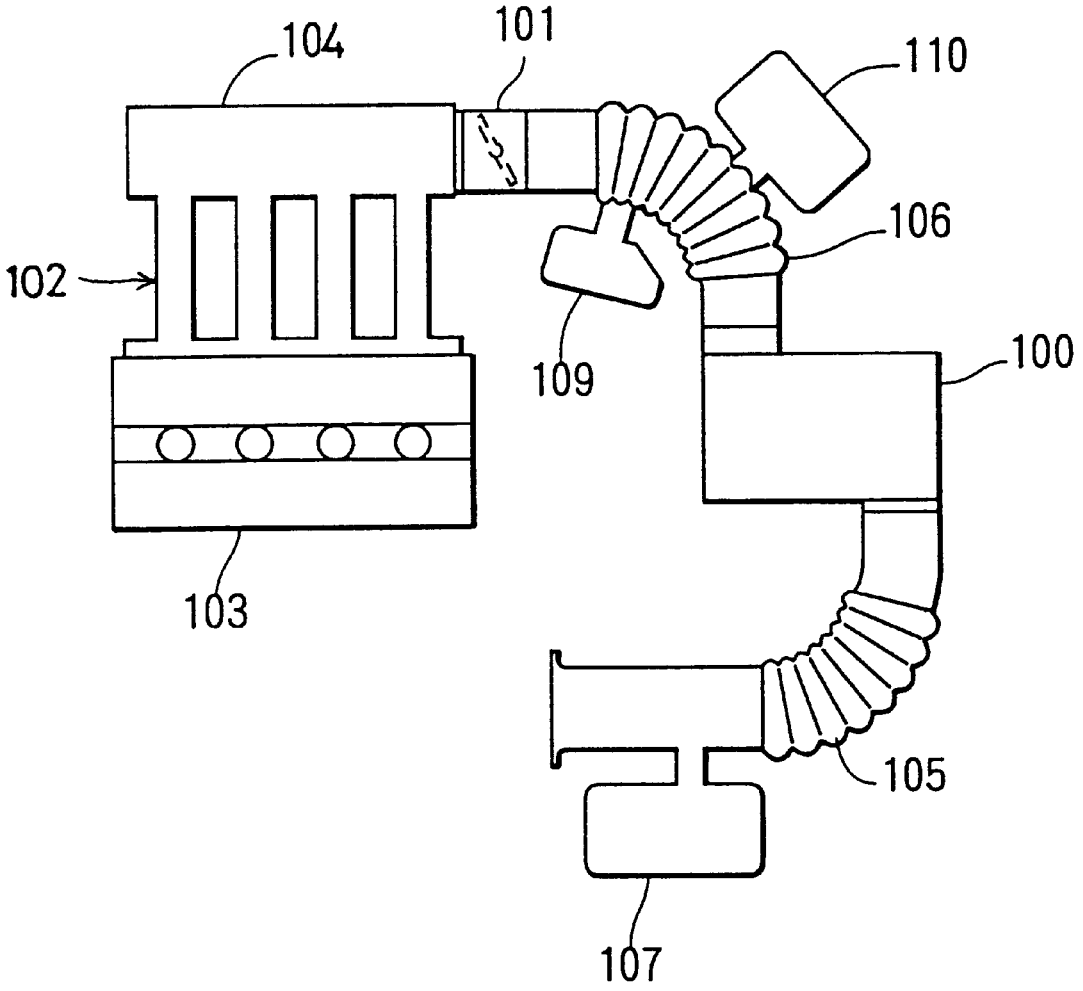
FIG. 14 PRIOR ART
FIG. 14 is a schematic view showing an intake system of a vehicle engine having a conventional noise silencer.

Further, as shown in FIG. 13, a noise collecting member 75 may be used instead of the noise collection member 70. The noise collection member 75 has a noise collection portion 76 having a parabolic cross-section. A concave surface 76*a* of the noise collection member 76 faces a direction in which noise comes from so that the concave portion 76*a* effectively collects noise. The noise collection valve 20 is disposed at a connection portion between the noise collection member 75 and the noise accumulation member 16. When sound pressure in the intake passage 10*a* is positive, a noise collection hole 76*b* is opened by the noise collection valve 20.

According to the first through fourth embodiments of the present invention, a positive sound pressure portion of low-frequency noise is selectively collected by the noise collection valve 20 into the noise accumulation room 17 and is discharged outside the intake system. On the other hand, a negative sound pressure portion of low-frequency noise is left in the intake passage 10*a*. Thus, low-frequency noise is separated into the positive sound pressure portion and the negative sound pressure portion through the noise collection valve 20. As a result, amplitude of low-frequency noise in the intake passage 10*a* is decreased, thereby reducing noise in the intake passage 10*a*. Further, in the first through fourth embodiments, noise in a wider frequency range can be collected into the noise accumulation room 17 by the noise collection valve 20 in comparison with a conventional resonator. Therefore, noise in a relatively wide frequency range can be effectively reduced. Further, in the above-mentioned first through third embodiments, high-frequency noise not collected by the noise collection valve 20 is reflected by the noise collection member 13, and is introduced into the noise receiving room 32 to be attenuated therein. Therefore, both high and low frequency noise can be effectively reduced.

Furthermore, in the above-mentioned first through fourth embodiments, the noise silencer can be disposed in the intake pipe 1 or the air cleaner 2, or can be formed using a part of the intake pipe 1. Therefore, size of the intake system including the noise silencer is reduced, and mounting position of the noise silencer can be determined with a relatively high flexibility.

Although the present invention has been fully described in connection with a preferred embodiment thereof with reference to the accompanying drawings, it is to be noted that various changes and modifications will become apparent to those skilled in the art.

Such changes and modifications are to be understood as being within the scope of the present invention as defined by the appended claims.

What is claimed is:

1. A noise silencer for reducing noise in an intake passage of an intake system, said noise silencer comprising:

a noise accumulation member having a noise collection hole into which noise is to be introduced from said intake passage, said noise accumulation member forming a noise accumulation room communicating with said noise collection hole and in open communication with a space having a predetermined pressure; and a valve disposed in said noise collection hole for opening and closing said noise collection hole in response to a sound pressure of the noise in said intake passage, wherein:

said valve opens said noise collection hole to make communication between said intake passage and said noise accumulation room when said sound pressure of the noise in said intake passage is larger than said predetermined pressure.

2. The noise silencer according to claim 1, wherein said noise accumulation member is disposed in said intake passage.

3. The noise silencer according to claim 1, further comprising:

a noise collection member disposed in said intake passage and having a parabolic portion for reflecting the noise; and a noise receiving member forming a noise receiving room communicating with said intake passage through a noise receiving hole, said noise receiving hole being disposed at a focal point of said parabolic portion for receiving the noise reflected by said parabolic portion.

4. The noise silencer according to claim 3, wherein said noise collection member and said noise accumulation member are integrally formed.

5. The noise silencer according to claim 3, wherein:

said noise collection member is composed of a first part of an intake pipe defining said intake passage therein; and said noise receiving member is composed of a second part of said intake pipe facing said first part of said intake pipe.

6. The noise silencer according to claim 5, wherein said first part and said second part of said intake pipe form a bent portion of said intake pipe.

7. The noise silencer according to claim 1, further comprising:

a noise collection member disposed in said intake passage for collecting the noise in said intake passage, said noise collection member having a hole communicating with said noise accumulation room through said noise collection hole.

8. A noise silencer according to claim 1, wherein said noise accumulation member is integrally formed with the intake passage.

9. A noise silencer according to claim 1, wherein said valve opens in response to a positive sound pressure of noise having a frequency of 200 Hz or less.

10. A noise silencer according to claim 1, wherein said predetermined pressure is atmospheric pressure.

11. A noise silencer according to claim 1, wherein said valve is directly controlled by the sound pressure of the noise in the intake passage.

12. A noise silencer for reducing noise in an intake passage of an intake system, said noise silencer comprising:

a noise accumulation member having a noise collection hole into which noise is to be introduced from said intake passage, said noise accumulation member forming a noise accumulation room communicating with said noise collection hole and a space having a predetermined pressure; and a valve disposed in said noise collection hole for opening and closing said noise collection hole according to a change in sound pressure of the noise in said intake passage, wherein:

said valve opens said noise collection hole to make communication between said intake passage and said noise accumulation room when sound pressure of the noise in said intake passage is larger than said predetermined pressure, wherein said valve is made of rubber.

13. A noise silencer for reducing noise in an intake passage of an intake system, said noise silencer comprising:

a noise accumulation member having a noise collection hole into which noise is to be introduced from said intake passage, said noise accumulation member forming a noise accumulation room communicating with said noise collection hole and a space having a predetermined pressure; and a valve disposed in said noise collection hole for opening and closing said noise collection hole according to a change in sound pressure of the noise in said intake passage, wherein:

said valve opens said noise collection hole to make communication between said intake passage and said noise accumulation room when sound pressure of the noise in said intake passage is larger than said predetermined pressure, and further comprising:

a noise collection member disposed in said intake passage and having a parabolic portion for reflecting the noise;

a noise receiving member forming a noise receiving room communicating with said intake passage through a noise receiving hole, said noise receiving hole being disposed at a focal point of said parabolic portion for receiving the noise reflected by said parabolic portion; and a sound absorbing member disposed on an inner wall of said noise receiving room for absorbing the noise.

14. A noise silencer for reducing noise in an intake system, said noise silencer comprising:

a noise accumulation member having a noise accumulation room communicating with said intake system through a noise collection hole, and in open communication with a space having a predetermined pressure; and a valve disposed in said noise collection hole for opening and closing said noise collection hole in response to a sound pressure of the noise in said intake system, wherein:

said valve opens said noise collection hole to make communication between said intake system and said noise accumulation room when said sound pressure of the noise in said intake system is larger than said predetermined pressure.

15. The noise silencer according to claim 14, wherein said noise accumulation room communicates with an intake passage of said intake system through said noise collection hole.

16. The noise silencer according to claim 14, wherein said noise accumulation room communicates with an air cleaner of said intake system through said noise collection hole.

17. A noise silencer according to claim 14, wherein said valve opens in response to a positive sound pressure of noise having a frequency of 200 Hz or less.

18. A noise silencer according to claim 14, wherein said noise accumulation member is integrally formed with the intake passage.

19. A noise silencer according to claim 14, wherein said predetermined pressure is atmospheric pressure.

20. A noise silencer according to claim 10, wherein said valve is directly controlled by the sound pressure of the noise in the intake passage.

* * * * *